US009856071B2

(12) United States Patent
Yamaguchi et al.

(10) Patent No.: US 9,856,071 B2
(45) Date of Patent: Jan. 2, 2018

(54) DISCHARGE CONTAINER AND METHOD FOR MANUFACTURING DISCHARGE CONTAINER

(71) Applicant: DAIZO Corporation, Osaka (JP)

(72) Inventors: Kazuhiro Yamaguchi, Kyoto (JP); Hidetoshi Miyamoto, Kyoto (JP)

(73) Assignee: DAIZO CORPORATION, Osaka (JP)

( * ) Notice: Subject to any disclaimer, the term of this patent is extended or adjusted under 35 U.S.C. 154(b) by 264 days.

(21) Appl. No.: 14/443,574

(22) PCT Filed: Nov. 13, 2013

(86) PCT No.: PCT/JP2013/080664
§ 371 (c)(1),
(2) Date: May 18, 2015

(87) PCT Pub. No.: WO2014/077273
PCT Pub. Date: May 22, 2014

(65) Prior Publication Data

US 2015/0344214 A1 Dec. 3, 2015

(30) Foreign Application Priority Data

Nov. 16, 2012 (JP) ..... 2012-252608
Dec. 28, 2012 (JP) ..... 2012-286764
Sep. 20, 2013 (JP) ..... 2013-196244

(51) Int. Cl.
*B65D 83/62* (2006.01)
*B65D 83/48* (2006.01)
(Continued)

(52) U.S. Cl.
CPC ..... *B65D 83/62* (2013.01); *B65B 7/285* (2013.01); *B65D 83/38* (2013.01); *B65D 83/48* (2013.01);
(Continued)

(58) Field of Classification Search
CPC ..... B65D 83/62; B65D 83/38; B65D 83/48; B65D 83/68; B65D 81/32; B65D 83/682; B65B 7/285; B65B 7/2857; B65B 7/2892
(Continued)

(56) References Cited

U.S. PATENT DOCUMENTS 2,658,714 A * 11/1953 Fooshee ..... B65D 83/205 222/394
3,176,890 A * 4/1965 Potapenko ..... B65D 83/48 222/402.2
(Continued)

FOREIGN PATENT DOCUMENTS

JP 10203573 A 8/1998
JP 11105893 A 4/1999
(Continued)

*Primary Examiner* — Paul R Durand
*Assistant Examiner* — Andrew P Bainbridge
(74) *Attorney, Agent, or Firm* — Browdy and Neimark, P.L.L.C.

(57) ABSTRACT

A discharge container includes a container body made of metal having an opening, and a valve assembly fixed to the opening of the container body. The container body has a cylindrical barrel portion, a cylindrical neck portion having a diameter smaller than the barrel portion, and a bead portion formed on top of the neck portion. The opening has a cylindrical portion and the bead portion formed above the cylindrical portion. The valve assembly is equipped with a plug portion inserted into the opening, a flange portion which is provided above on the bead portion, a valve structure which opens and closes a pathway of a content and is fixed to the plug portion, an O-ring provided on an outer surface of the plug portion, and a cover cap fixing the valve assembly to the container body.

11 Claims, 11 Drawing Sheets

(51) Int. Cl.

| | |
|---|---|
| ***B65B 7/28*** | (2006.01) |
| ***B65D 83/38*** | (2006.01) |
| ***B65D 83/68*** | (2006.01) |
| *B65D 81/32* | (2006.01) |
| *B65D 83/32* | (2006.01) |

(52) U.S. Cl.
CPC ..... *B65D 83/68* (2013.01); *B65B 7/2857* (2013.01); *B65B 7/2892* (2013.01); *B65D 81/32* (2013.01); *B65D 83/32* (2013.01)

(58) Field of Classification Search
USPC ..... 222/542, 402.1–402.24, 464.1–464.7, 1, 222/105
See application file for complete search history.

(56) References Cited

U.S. PATENT DOCUMENTS

| | | | | | |
|---|---|---|---|---|---|
| 3,549,050 | A * | 12/1970 | Bruce | B65D 83/62 | 222/402.22 |
| 4,958,757 | A * | 9/1990 | Greenebaume, II | B65D 83/38 | 222/394 |
| 5,035,106 | A * | 7/1991 | Haase | B65B 7/285 | 29/511 |
| 6,581,807 | B1 * | 6/2003 | Mekata | B65D 83/54 | 222/402.1 |
| 8,434,648 | B2 * | 5/2013 | Marie | B65D 83/36 | 222/402.1 |
| 2004/0084483 | A1 * | 5/2004 | Martin | B65D 83/525 | 222/402.1 |
| 2009/0008584 | A1 * | 1/2009 | Fontela | B65D 83/54 | 251/118 |
| 2010/0096279 | A1 * | 4/2010 | Kojima | B21D 51/26 | 206/6 |
| 2012/0168463 | A1 * | 7/2012 | Hanai | B65D 83/62 | 222/135 |
| 2013/0284759 | A1 * | 10/2013 | Teramoto | B65D 83/384 | 222/94 |
| 2014/0008389 | A1 * | 1/2014 | Mekata | B65D 83/20 | 222/94 |
| 2015/0344214 | A1 * | 12/2015 | Yamaguchi | B65D 83/38 | 222/95 |

FOREIGN PATENT DOCUMENTS

| | | | |
|---|---|---|---|
| JP | 2002002737 | | 1/2002 |
| JP | 2012131553 | A | 7/2012 |
| WO | 2005065841 | | 7/2005 |
| WO | 2011067868 | A1 | 3/2010 |
| WO | 2012057342 | A1 | 5/2012 |

* cited by examiner

[Fig. 1]
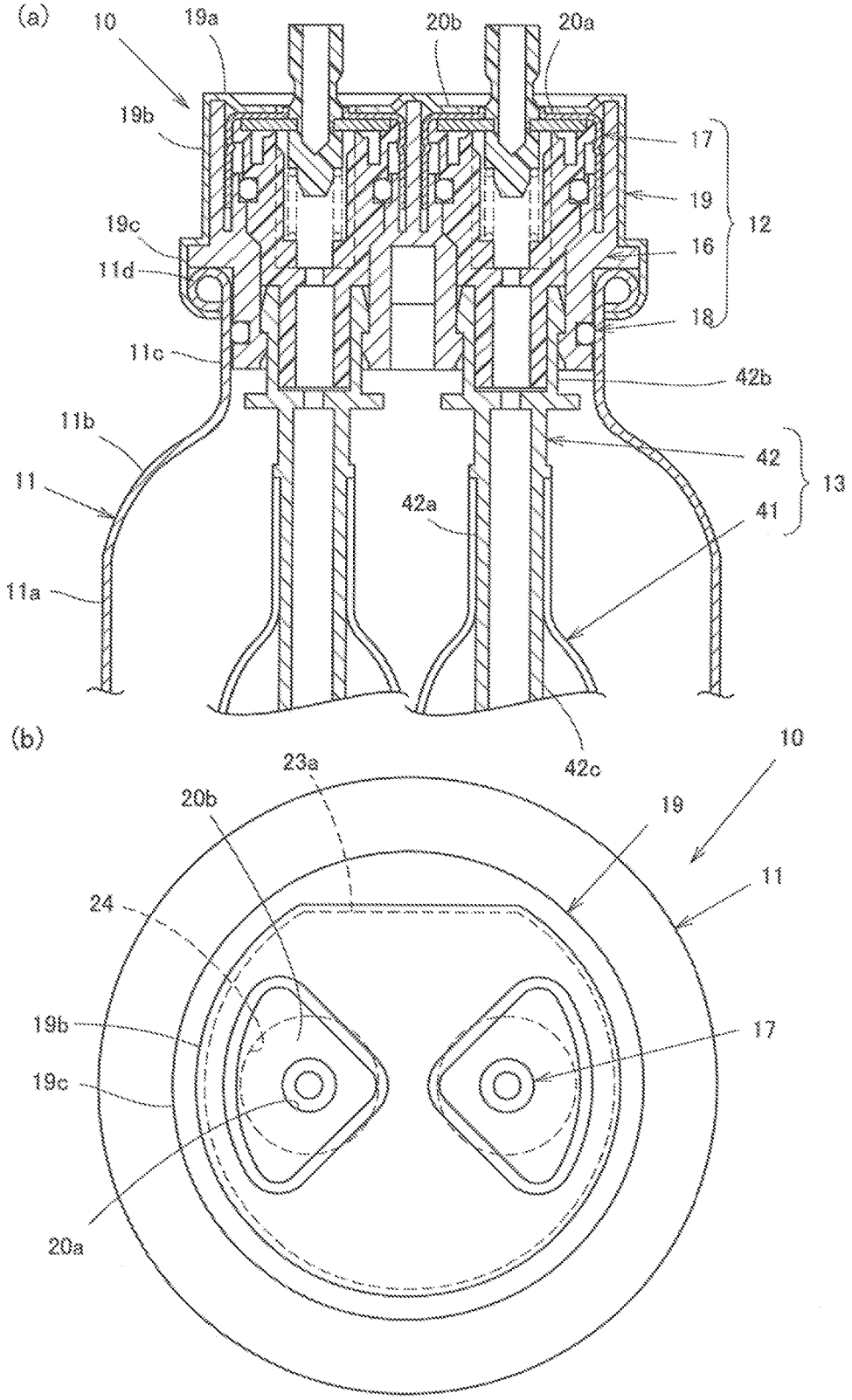

[Fig. 2]
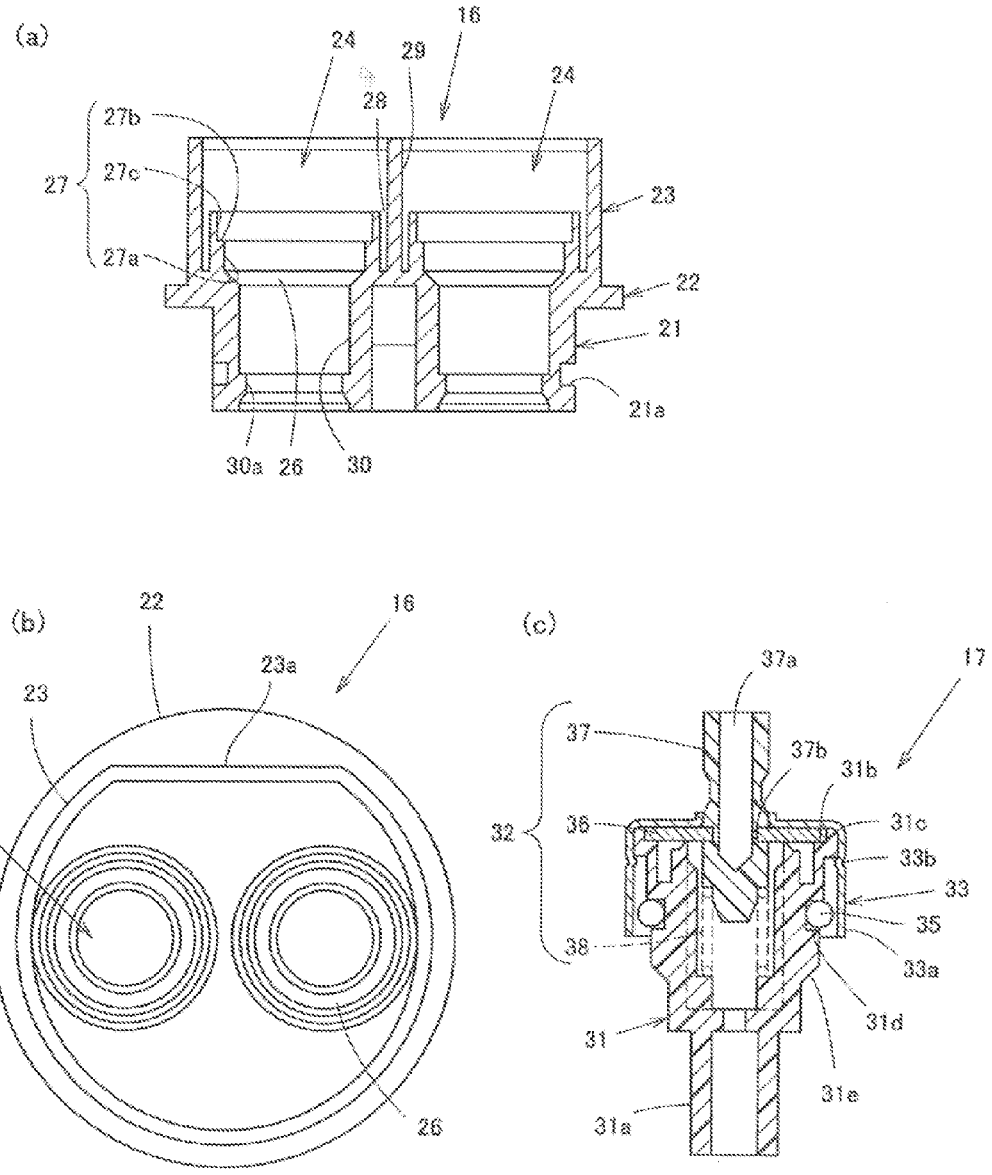

[Fig. 3]
(a)
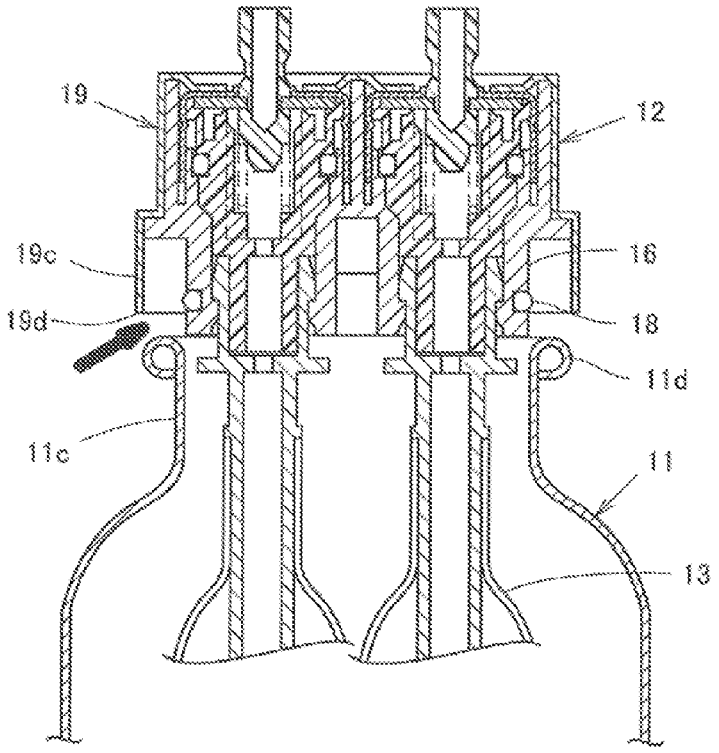
(b)
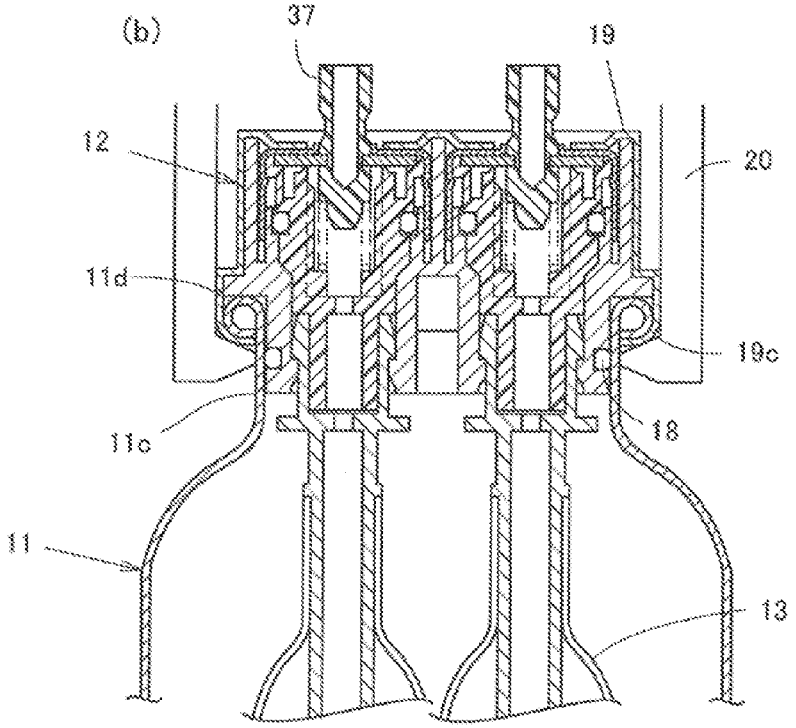

[Fig. 4]
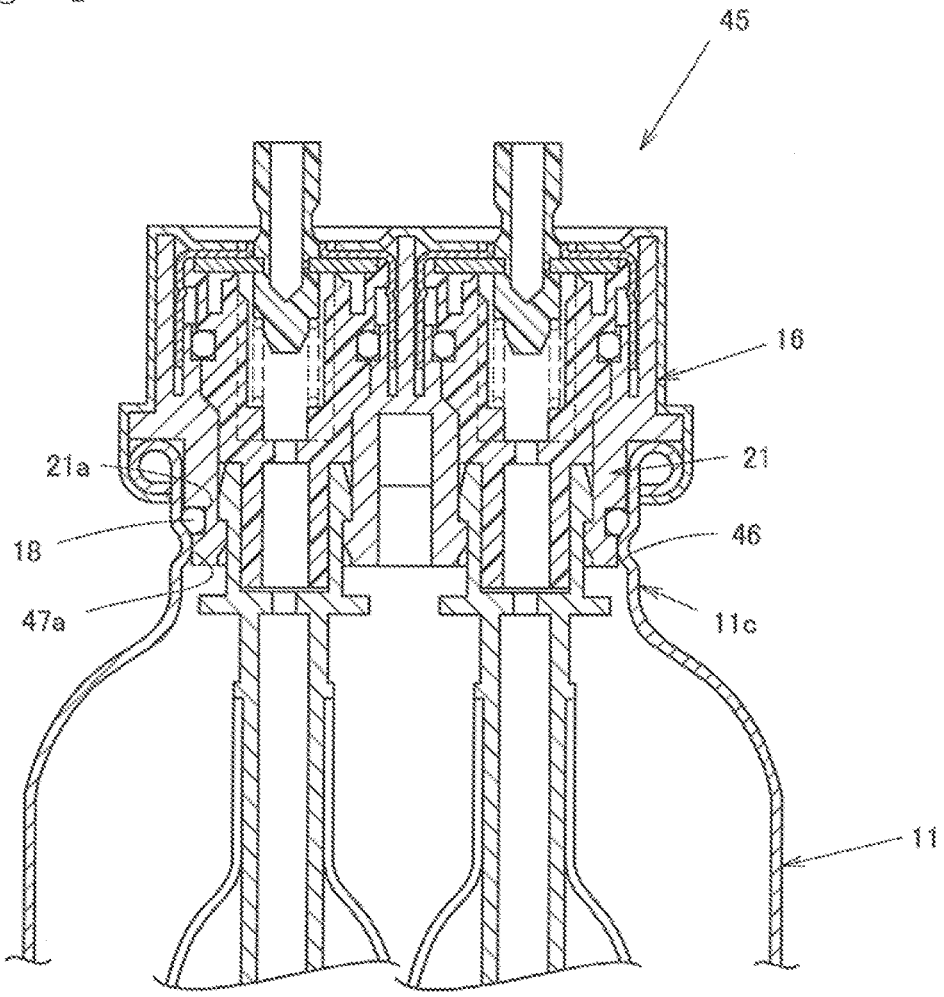

[Fig. 5]
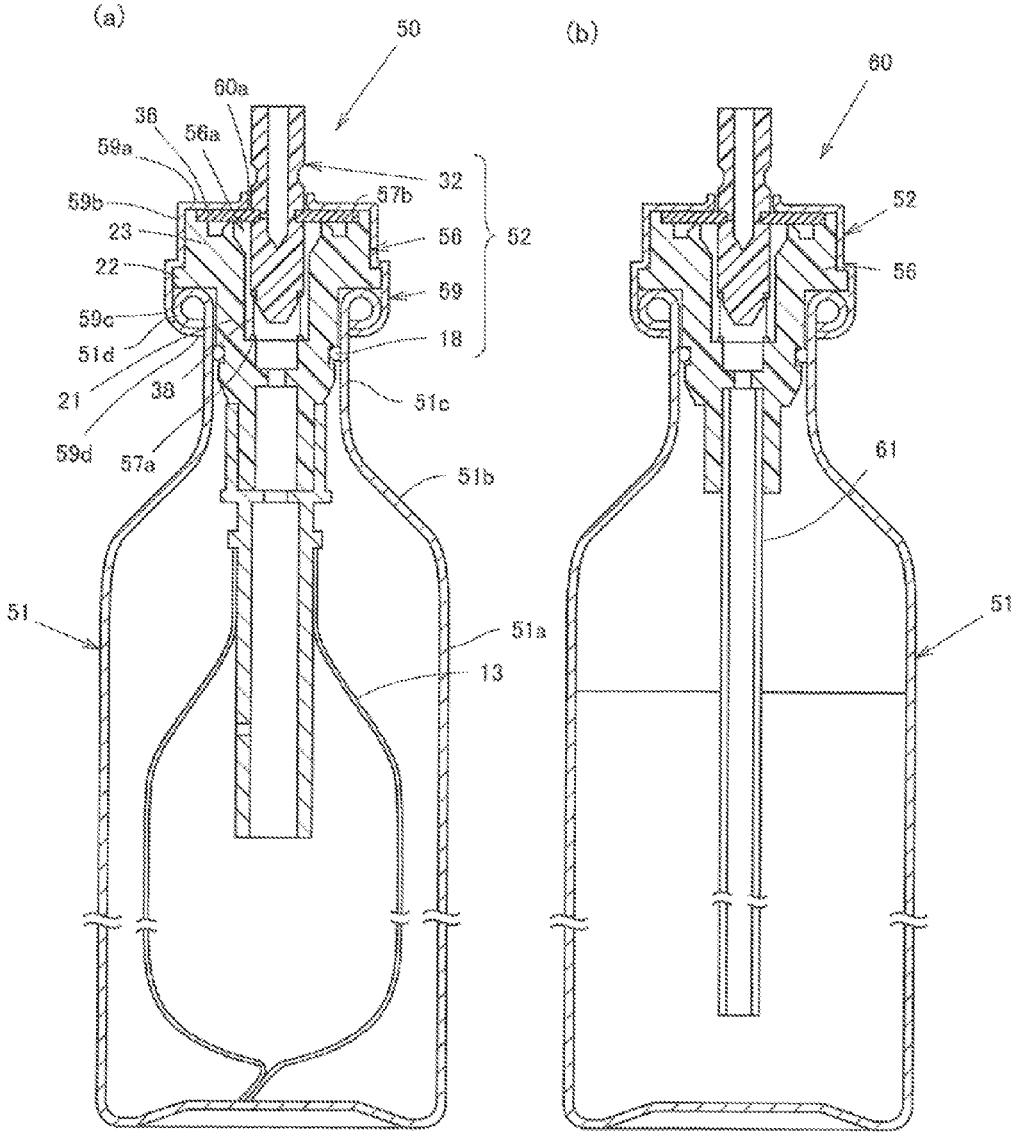

[Fig. 6]
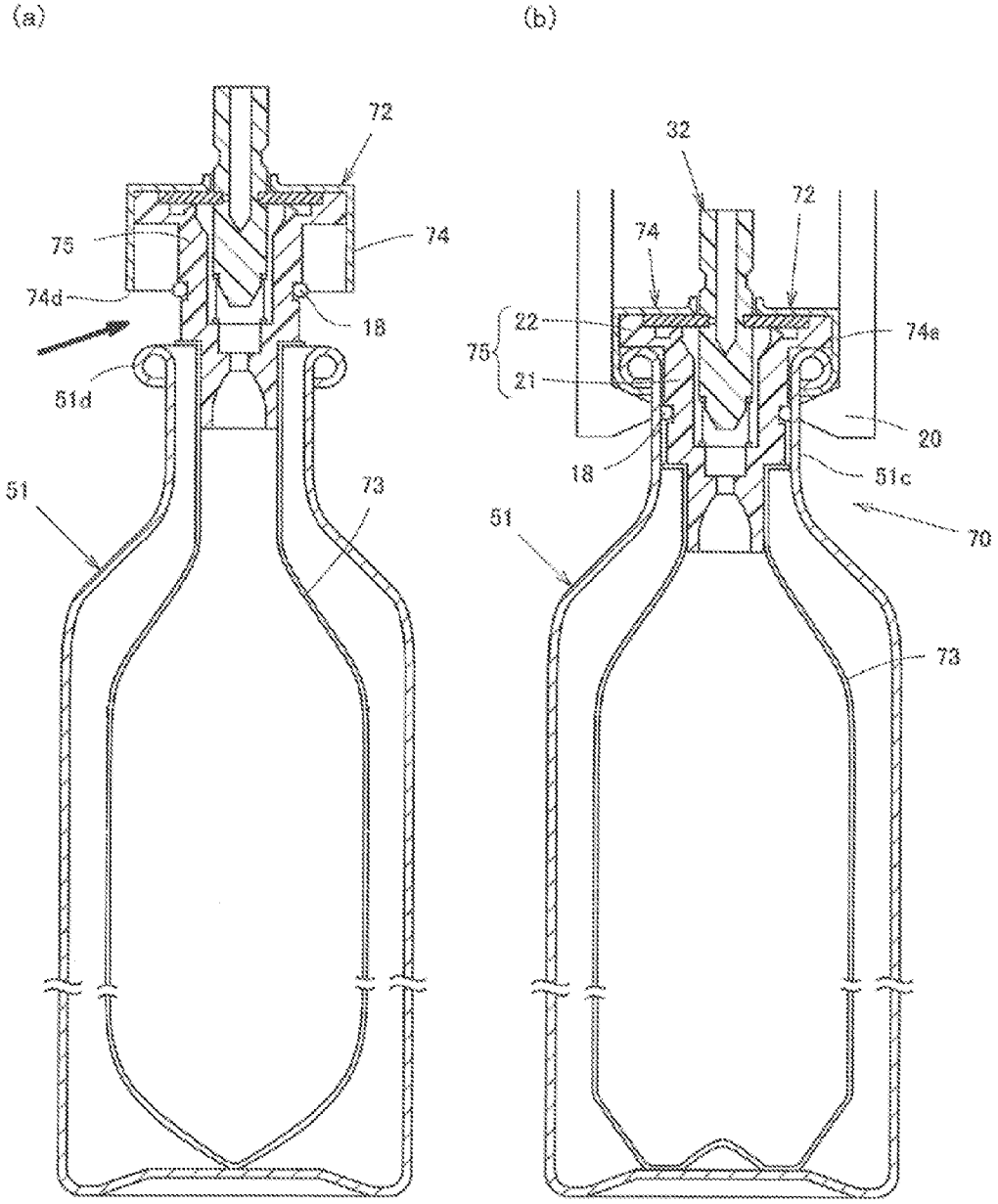

[Fig. 7]
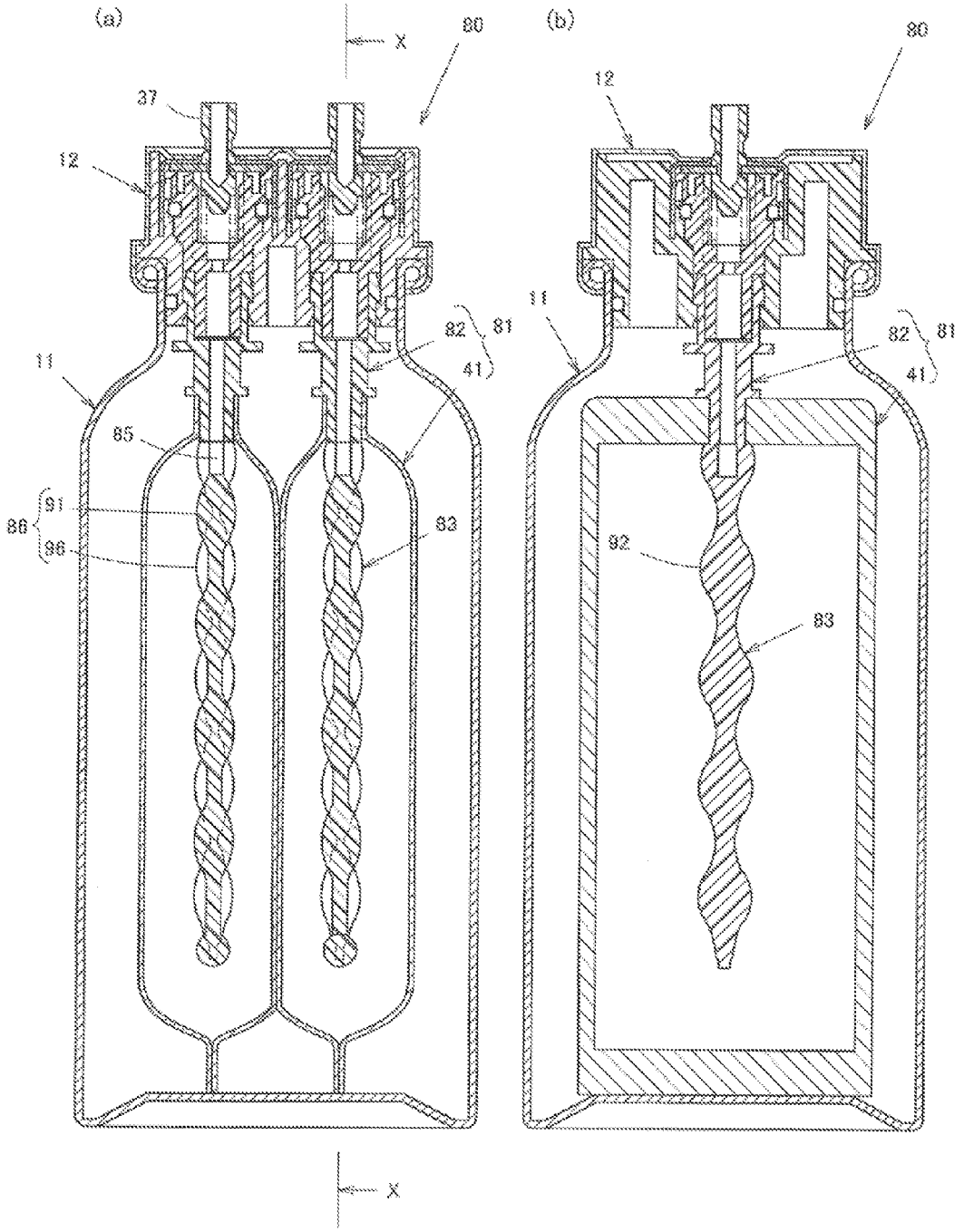

[Fig. 8]
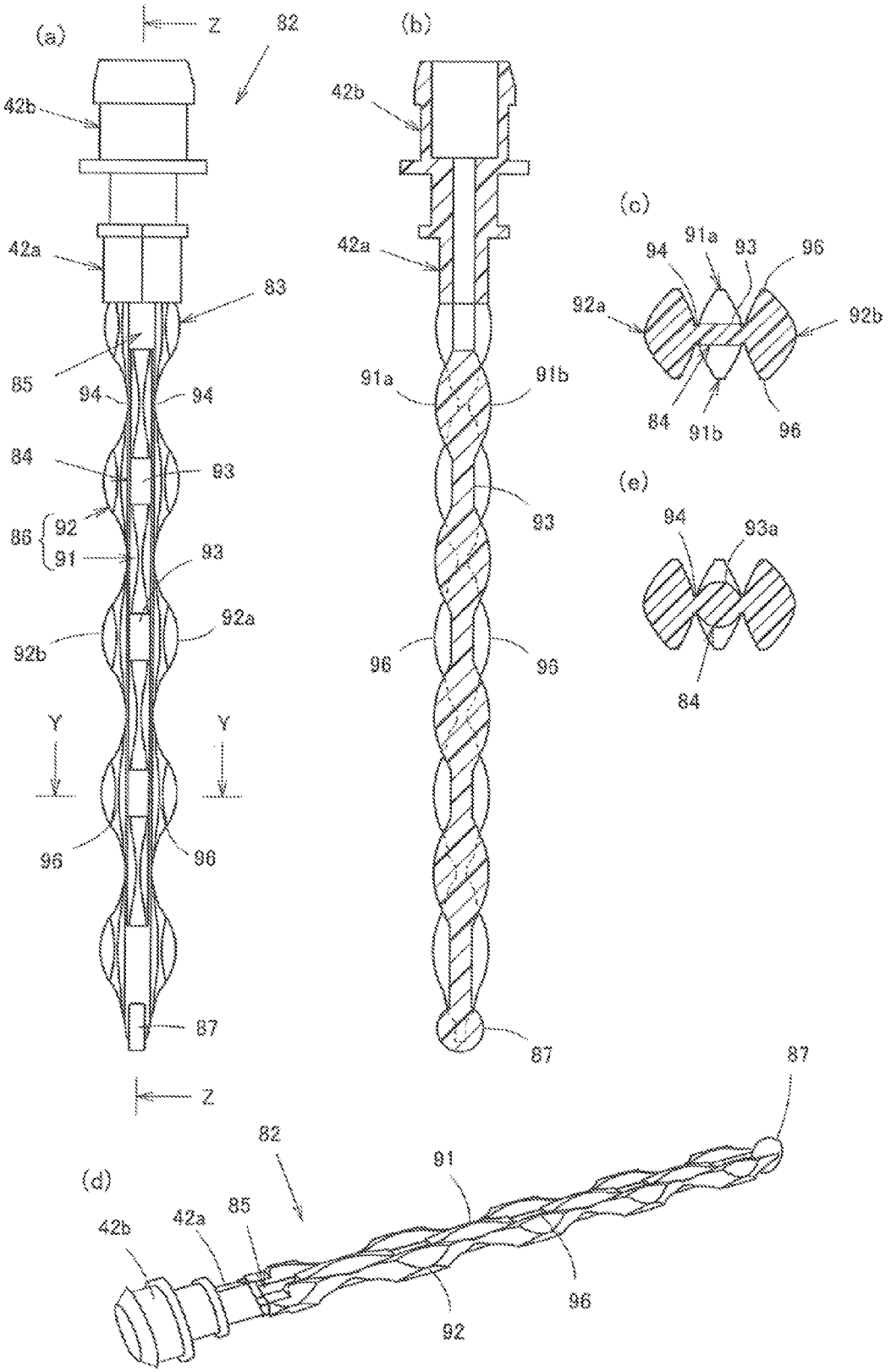

[Fig. 9]
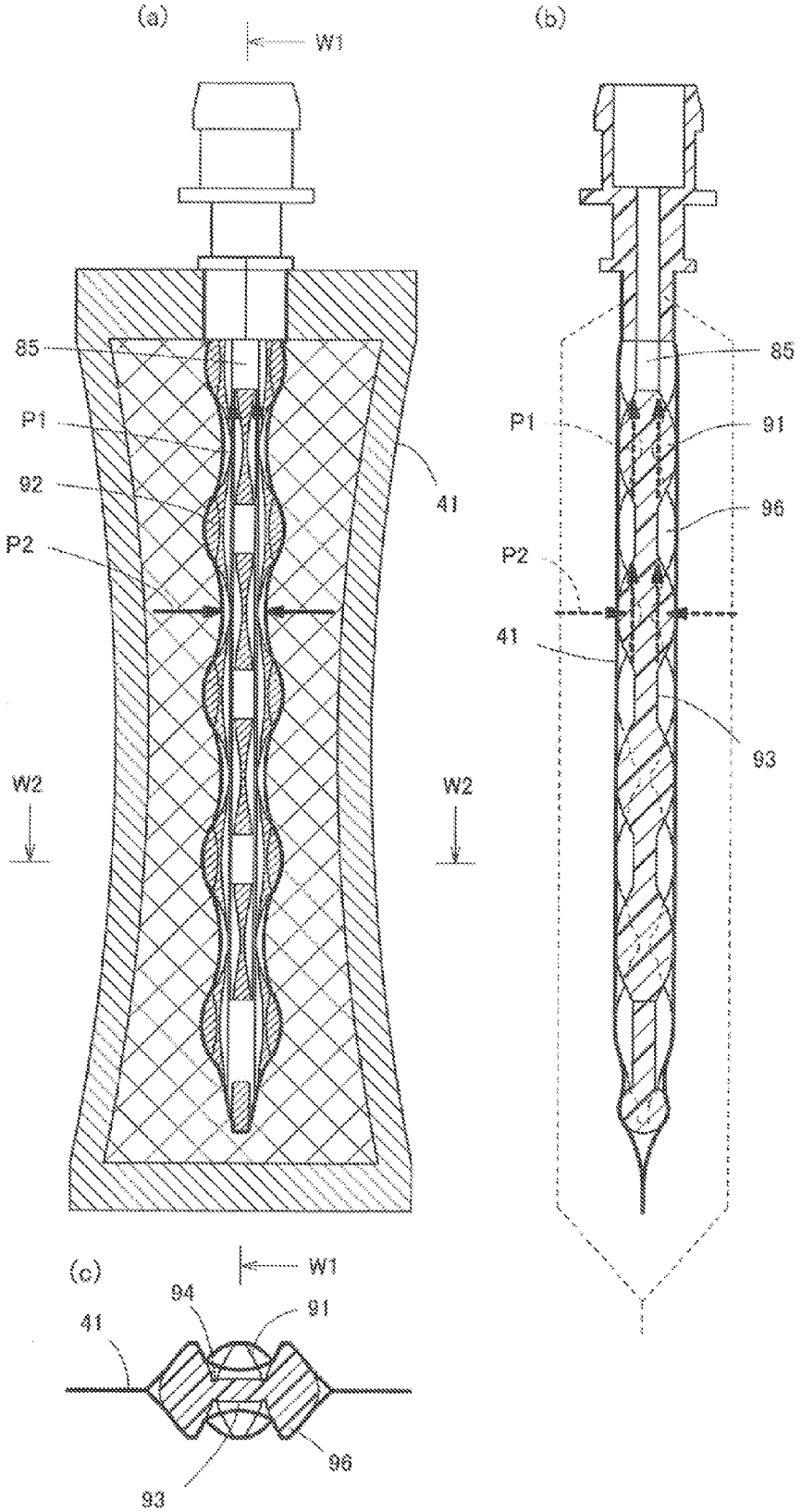

[Fig. 10]
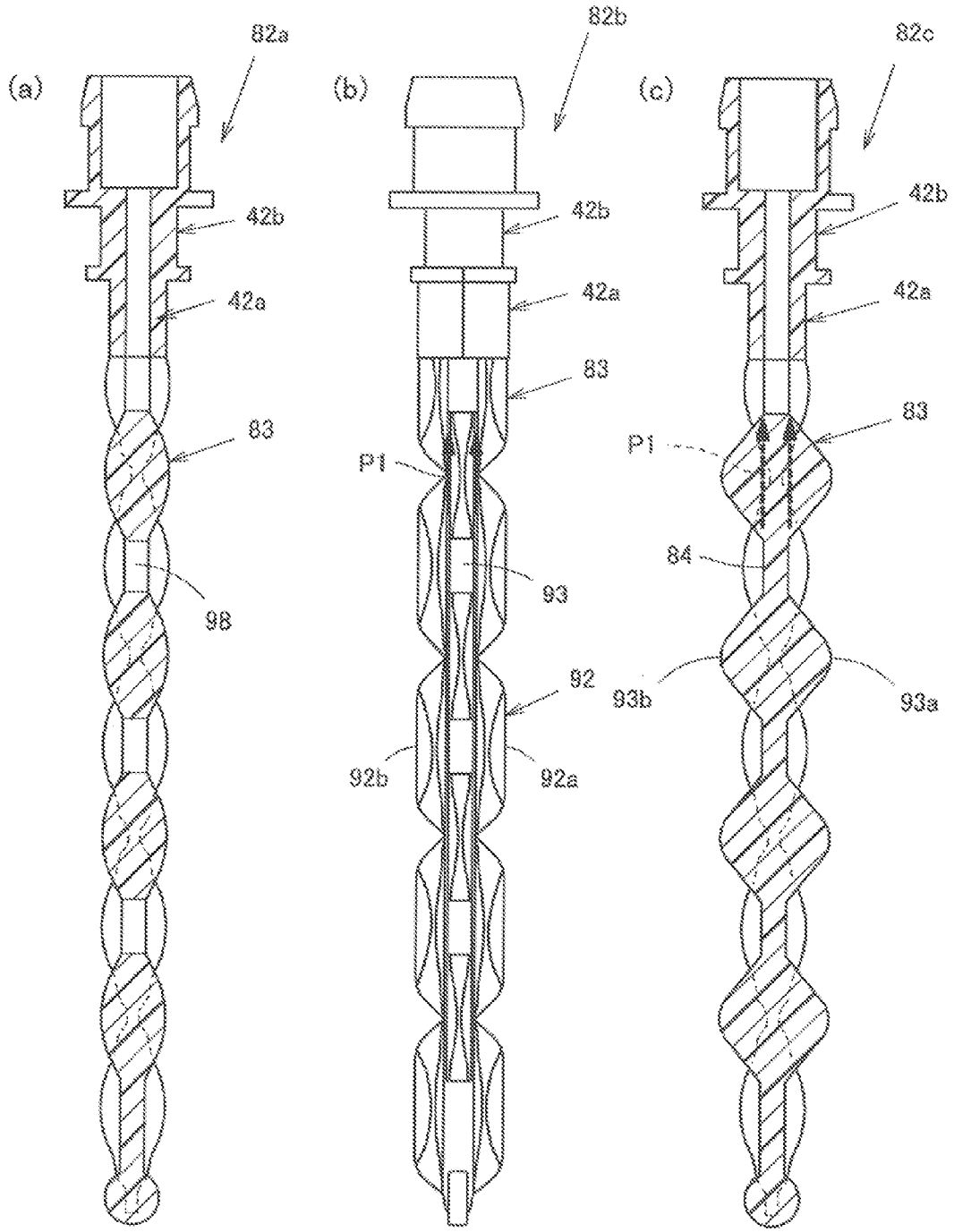

[Fig. 11]
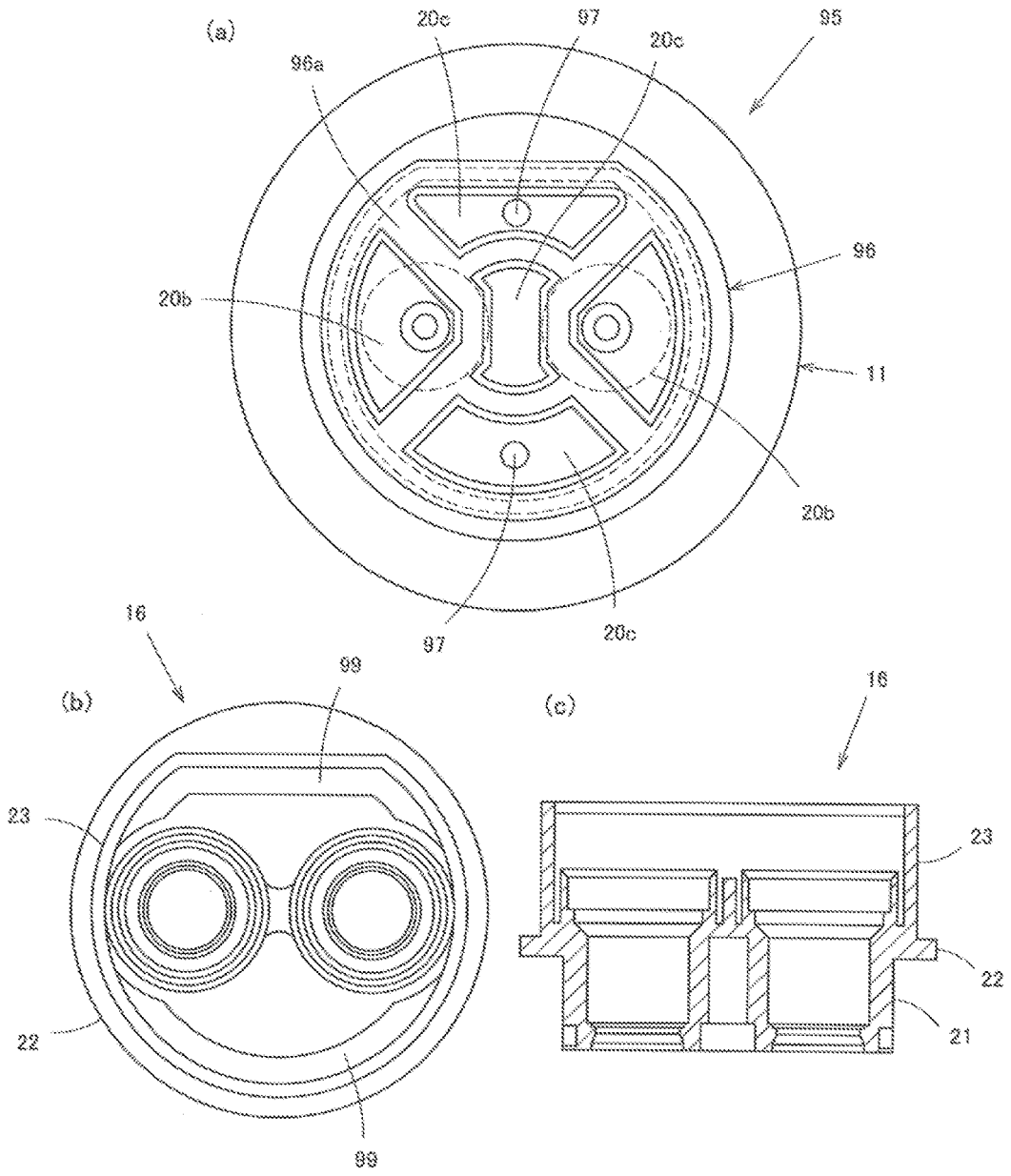

DISCHARGE CONTAINER AND METHOD FOR MANUFACTURING DISCHARGE CONTAINER

FIELD OF INVENTION

The present invention relates to a discharge container.

DESCRIPTION OF BACKGROUND ART

For a container which discharges plural (contents, for example, shown in Patent document 1 and FIG. 13 of Patent document 2, a container equipped with a container body having a bead portion and a valve assembly fixed on the opening of the container body is known. The valve assembly of the container has a plug body which fixes two valve structures and a cover cap which unites the components of the valve assembly and fixes the valve assembly to the container body.

PRIOR ART DOCUMENTS

Patent Documents

Patent Document 1: WO 2011/067868

Patent Document 2: Japanese published patent application No. 2012-131553

DESCRIPTION OF THE INVENTION

Problems to be Solved

However, in the case where the part of the container body below the bead portion is tapered like shown in container of Patent Document 1, there is a possibility that the cover cap come off due to the weak engagement force between the container body and the cover cap of the valve assembly in which the cover cap is clinched to the bead portion. Further, because the sealing member is provided between the container body and the cover cap, the sealing force decreases in tandem with the engaging force.

Moreover, in the case where the sealing member is provided on the inner surface of the bead portion like shown in FIG. 13 of Patent Document 2, there is a problem that the wrinkle formed on the inner surface of the bead portion during the forming of the container body forms the pathway for the propellant to be leaked from the container body, even if the sealing member is pressed to the inner surface of the bead portion. Specifically, while the bead portion is formed by applying the necking processing to the upper part of the barrel portion to reduce the diameter of the neck portion and applying the curling processing to the top of the neck portion, the wrinkle is formed on the inner surface of the neck portion or the synthetic resin coating of the neck portion while the necking processing. Further, the wrinkle formed on the necking processing is further deepened at the curling processing. Because, the sealing member is already provided on the inner surface of the bead portion when it is formed, the deformation amount of the sealing member can not be controlled according to the condition of the bead portion formed on the container body.

The first aspect of the present invention is directed to the discharge container having high sealing property where it is formed by firmly fixing the valve assembly to the container body made of metal having the bead.

The second aspect of the present invention is directed to the passage member and the discharge container using the same in which the remaining amount at the end is small because the pathway for the content is secured even if the content is lessen and the pouch shrunk.

The third aspect of the present invention is directed to the discharge container with high productivity.

Means of Solving the Problem

The present invention of discharge container is characterized in that it comprises a container body made of metal having an opening, and a valve assembly fixed to the opening of the container body; where the opening has a cylindrical portion and a bead portion formed above the cylindrical portion; where the valve assembly has a plug portion inserted into the opening, a valve structure which opens and closes a pathway of a content and is fixed to the plug portion, a sealing member provided on an outer surface of the plug portion, and a cover cap fixing the valve assembly to the container body; where the cover cap has an upper portion covering the plug portion and the valve structure and a plastic deformation portion fixed to the bead portion by deforming in a central direction; and where the sealing member contacts with a part of the cylindrical portion lower than the plastic deformation portion and seals a gap between the container body and the plug portion.

In the discharge container, it is preferable that the container body has a cylindrical barrel portion, a neck portion having a diameter smaller than the barrel portion, and the bead portion formed on top of the neck portion.

It is preferable that the valve assembly is equipped with a valve holder which retains plural of valve structures and that the plug portion is formed on an outer surface of the valve holder.

It is preferable that the valve structure is housed in a housing configuring the pathway; that the valve structure is united with the housing by a cap covering the housing; and that the housing is fixed to the plug portion.

However, the valve structure may be housed in a penetrating hole of the plug portion configuring the pathway.

In the discharge container of the present invention, it is preferable that it comprises a pouch housed in the container body, and a joint member connecting the pouch and the valve assembly; where the joint member has a tubular valve connecting portion which is fixed to the valve assembly, a tubular pouch fixing portion concentrically provided on a lower end of the valve connecting portion which is fixed to the an opening of the pouch, and a guiding portion extending to a bottom portion of the pouch from a lower end of the pouch fixing portion which is to guide the content into the pouch fixing portion; where the guiding portion has a main body extending in vertical direction, a communicating portion provided on a upper end of the main body which is to communicates a surface of the main body with a center hole of the pouch fixing portion, and a projecting portion projecting from the main body; and where the projecting portion is equipped with at least two main projections formed concentrically and formed apart in vertical direction.

In the discharge container of present invention, it is preferable that the valve assembly is equipped with a valve holder having the plug portion retaining the valve structure which is to be inserted into the opening of the container body and a flange portion arranged on an upper end of the opening of the container body; where the cover cap covers the valve holder and fixes the valve holder to the container body; and where a portion covering the valve holder of the cover cap is formed with a penetrating hole.

The present invention of a method for manufacturing the discharge container is characterized in that it comprises the steps of bringing the sealing member into contact with the cylindrical portion by inserting the plug portion of the valve assembly into the container body, fixing the valve assembly to the container body by plastically deforming a lower portion of the cover cap of the valve assembly with clinch claws depressing in center direction, and at the same time, controlling a outer diameter of the cylindrical portion of the container body with tips of the clinch claws.

The second aspect of the present invention of the discharge container is characterized in that it comprises a container body having a pressure resistance, a pouch housed in the container body, a valve assembly fixed to an opening of the container body, and a joint member connecting the valve assembly and the pouch; where the joint member has a tubular valve connecting portion which is fixed to the valve assembly, a tubular pouch fixing portion concentrically provided on a lower end of the valve connecting portion which is fixed to an opening of the pouch, and a guiding portion extending to a bottom portion of the pouch from a lower end of the pouch fixing portion which is to guide the content into the pouch fixing portion; where the guiding portion has a main body extending in vertical direction, a communicating portion provided on an upper end of the main body which is to communicate a surface of the main body with a center hole of the pouch fixing portion, and a projecting portion projecting from the main body; and where the projecting portion is equipped with at least two main projections formed concentrically and formed apart in vertical direction.

In the discharge container of the second aspect or in the discharge container having the joint member with the projecting portion of the first aspect, it is preferable that the projecting portion has at least two main projections and a sub projection provided between the main projections parted in vertical direction and provided as not to intersect with either main projections.

In the case where it is equipped with the main projection and the sub projection, it is preferable that a channel is formed on a foot of the main projection in parallel with the main projection. Further, it is preferable that the main projection is projected perpendicular to the surface of the pouch, and the sub projection is projected parallel to the surface of the pouch. Moreover, it is preferable that the sub projection projecting in parallel with the surface of the pouch is equipped with a projection projecting perpendicular to the surface of the pouch. Additionally, it is preferable that the sub projection is equipped with a first sub projection projecting in parallel with the surface of the pouch and a second sub projection projecting in parallel with the surface of the pouch and projecting 180 degree against the first sub projection.

In the discharge container of the second aspect or in the discharge container having the joint member with the projecting portion of the first aspect, it is preferable that the projection portion is equipped with at least two first main projections formed concentrically and at least two second main projections formed concentrically and formed in parallel with the first main projections.

The third aspect of the present invention of the discharge container is characterized in that it comprises a container body having pressure resistance and a valve assembly for an aerosol fixed on an opening of the container body; where the valve assembly has a valve structure which communicates an atmosphere with the container body when operated, a valve holder equipped with a plug portion inserted into the opening of the container body and a flange portion provided on a top of the opening of the container body, and a cover cap which covers the valve holder and which fixes the valve holder to the container body; where a gap between the valve holder and the opening of the container body is sealed; and where a penetrating hole is formed on a part of the cover cap which covers the valve holder.

In the discharge container of the third aspect or in the discharge container having the cover cap with the penetrating hole of the first aspect, it is preferable that the penetrating hole is formed on a top face of the cover cap. However, the penetrating hole may be formed on a lateral face of the cover cap.

In the discharge container of the third aspect or in the discharge container having the cover cap with the penetrating hole of the first aspect, it is preferable that the cover cap has a fixing portion fixing the valve holder and the container body by pressing the flange portion of the valve holder and the container body in vertical direction; and that the penetrating hole is formed on the upper surface of the fixing portion.

In the discharge container of the third aspect or in the discharge container having the cover cap with the penetrating hole of the first aspect, it is preferable that a guiding channel which communicates the penetrating holes with an upper surface of the valve holder of the valve assembly closing the container body is formed.

Effect of the Invention

In the discharge container of the present invention, because it is equipped with a container body made of metal having an opening, and a valve assembly fixed to the opening of the container body; where the opening has a cylindrical portion and a bead portion formed above the cylindrical portion, where the valve assembly has a plug portion inserted into the opening, a valve structure which opens and closes a pathway of a content and is fixed to the plug portion, a sealing member provided on an outer surface of the plug portion, and a cover cap fixing the valve assembly to the container body; where the cover cap has an upper portion covering the plug portion and the valve structure and a plastic deformation portion fixed to the bead portion by deforming in a central direction; and where the sealing member contacts with a part of the cylindrical portion lower than the plastic deformation portion and seals a gap between the container body and the plug portion, the outer diameter of the part of the cylindrical portion which contacts with the sealing member can be controlled when deforming the lower part of the cover cap. In other word, the sealing property of the sealing structure can be controlled at the final stage of the manufacturing process. Therefore, sealing structure having high durability and having high accuracy can be obtained. Further, the fixture of the container body and the cover cap is accomplished between the bead portion of the container body and the cover cap, and the sealing between the container body and the cover cap is accomplished between the cylindrical portion of the container body and the plug portion, that is to say the fixing structure and the sealing structure are independent with each other. Therefore, the process is simple. Moreover, because the opening of the container has the cylindrical portion and the bead portion formed above the upper side of the cylindrical portion, the lower part of the cover cap can be deformed deeply against the cylindrical portion, resultantly, the container body and the valve assembly can be strongly fixed.

In the discharge container where the container body has a cylindrical barrel portion, a neck portion having diameter small than the barrel portion, and a bead portion formed on top of the neck portion, the sealing property is high, even if the wrinkle is formed on the inner surface of the neck portion or the synthetic resin coating formed on the inner surface of the neck portion when forming the neck portion during necking process. That is because, the sealing can be formed by controlling the outer diameter of the part of the cylindrical portion contacting with the sealing member. Note that when the synthetic resin coating is provided on the inner surface of the neck portion after forming the neck portion or necking process, the sealing property which can seal the propellant can not be obtained reproductively.

In the case where the valve assembly has the valve holder which holds plural of valve structures and where the plug portion is formed on the outer surface of the valve holder, plural of contents can be stored and plural of stored contents can be independently discharged by providing plural of valve structure.

In the case where the valve structure is housed in a housing configuring the pathway, where the valve structure is united with the housing by a cap covering the housing, and where the housing is fixed to the plug portion, the sealing property of the valve structure can be secured by fixing the valve structure to the housing with the cap. Therefore, the sealing property is high. In the case where the sealing property of the valve structure is obtained by fixing the valve structure to the housing with the cover cap like shown in Patent Document 1, the performance of the valve structure will be depend on the engaging force of the cover cap to the container body, and the production process will be cumbersome.

In the case where the valve structure is housed in a penetrating hole of the plug portion configuring the pathway, although the production process will be cumbersome, the downsizing of the valve assembly is possible and use of the material can be reduced.

In the discharge container of the present invention having a pouch housed in the container body and a joint member connecting the pouch and the valve assembly, and where the joint member has a tubular valve connecting portion which is fixed to the valve assembly, a tubular pouch fixing portion concentrically provided on a lower end of the valve connecting portion which is fixed to the an opening of the pouch, and a guiding portion extending to a bottom portion of the pouch from a lower end of the pouch fixing portion which is to guide the content into the pouch fixing portion, and where the guiding portion has a main body extending in vertical direction, a communicating portion provided on an upper end of the main body which is to communicates a surface of the main body with a center hole of the pouch fixing portion, and a projecting portion projecting from the main body, and where the projecting portion is equipped with at least two main projections formed concentrically line and formed apart in vertical direction, even when the remaining of the content become small and the pouch shrunk, the flow passage of the content to the center hole of the pouch fixing portion in the pouch is secured, the content can be discharge till the last.

In the discharge container of the present invention where the valve assembly is equipped with a valve holder having the plug portion retaining the valve structure which is to be inserted into the opening of the container body, and a flange portion arranged on an upper end of the opening of the container body, and where the cover cap covers the valve holder and fixes the valve holder to the container body, and a portion covering the valve holder is formed with a penetrating hole, the propellant which is accumulated between the valve holder and the cover cap can be ejected through the penetrating hole.

The present invention of a method for manufacturing the discharge container where the sealing member is being brought into contact with the cylindrical portion by inserting the plug portion of the valve assembly into the container body, where the valve assembly is fixed to the container body by plastically deforming a lower portion of the cover cap of the valve assembly with clinch claws depressing in center direction, and at the same time, where the outer diameter of the cylindrical portion of the container body is controlled by the tips of the clinch claws, the deforming amount of the sealing member can be controlled at the last stage of the manufacturing method, therefore, the product having high durability of the sealing property and accurate product can be constantly produced.

In the second aspect of the discharge container of the present invention, because it is equipped with a container body having a pressure resistance, a pouch housed in the container body, a valve assembly fixed to an opening of the container body, and a joint member connecting the valve assembly and the pouch; where the joint member has a tubular valve connecting portion which is fixed to the valve assembly, a tubular pouch fixing portion concentrically provided on a lower end of the valve connecting portion which is fixed to an opening of the pouch, and a guiding portion extending to a bottom portion of the pouch from a lower end of the pouch fixing portion which is to guide the content into the pouch fixing portion; where the guiding portion has a main body extending in vertical direction, a communicating portion provided on an upper end of the main body which is to communicate a surface of the main body with a center hole of the pouch fixing portion, and a projecting portion projecting from the main body; and where the projecting portion is equipped with at least two main projections formed concentrically and formed apart in vertical direction, even when the remaining of the content become small and the pouch shrunk, the flow passage of the content to the center hole of the pouch fixing portion in the pouch is secured, and the content can be discharged till the last. Particularly, because the projecting portion projected from the main body is equipped with at least two main projections formed concentrically and formed apart in vertical direction, the surface area of the whole guiding portion still increased due to the asperity formed on the main body, and the space between the pouch and the guiding portion tends to be formed when the pouch shrunk. Especially, the space of the flow path tends to be form between the foot of the main projection and the pouch, parallel with the main projection. Further, a large flow path is secured with a space formed on the surface (surface of the main body of the guiding portion) between vertically adjacent main projections. Further, the flow path generated by the main projections and the planar space are concentrically formed, the contents can be guided efficiently.

In the third aspect of the discharge container of the present invention, because it is equipped with a container body having pressure resistance and a valve assembly for an aerosol fixed on an opening of the container body; where the valve assembly has a valve structure which communicates an atmosphere with the container body when operated, a valve holder equipped with a plug portion inserted into the opening of the container body and a flange portion provided on a top of the opening of the container body, and a cover cap which covers the valve holder and which fixes the valve holder to the container body; where a gap between the valve holder and the opening of the container body is seated; and where a penetrating hole is formed on a part of the cover cap which covers the valve holder, the propellant intruded between the valve holder and the cover cap during the under-cup charging which charges the propellant into the container body through the gap between the container body and the valve holder, can be ejected through the penetrating hole. Therefore, the difference between the ejection of the intruded propellant and the leak of the propellant due to the defect assembling of the valve assembly can be easily detected, so the propellant leak test can be operated accurately.

BRIEF DESCRIPTION OF THE DRAWINGS

FIG. 1*a*, 1*b* are a cross sectional view and a plan view showing an embodiment of the discharge container of the present invention.

FIG. 2*a*, 2*b* are cross sectional views of the valve holder of the discharge container of FIG. 1, and FIG. 2*c* is a side cross sectional view of the aerosol valve of the discharge container of FIG. 1.

FIG. 3*a*, 3*b* are outlines of the manufacturing method of the discharge container of FIG. 1.

FIG. 4 is a cross sectional view showing the other embodiment of the discharge container of the present invention.

FIG. 5*a*, 5*b* are cross sectional views further showing the other embodiment of the discharge container of the present invention.

FIG. 6*a*, 6*b* are outlines of the manufacturing method of the other embodiment of the discharge container of the present invention.

FIG. 7*a*, 7*b* are a cross sectional view and X-X line sectional view showing the other embodiment of the discharge container of the present invention.

FIG. 8*a* is a front view showing the joint member used in the discharge container of FIG. 7, FIG. 8*b*, 8*c* are Z-Z line sectional view and Y-Y line sectional view respectively FIG. 8*d* is a perspective view of the joint member, and 8*e* is a cross sectional view of the other embodiment of the joint member.

FIG. 9*a* is a schematic view showing the guiding portion of the joint member of the discharge container of FIG. 7 when the pouch is shrunk, FIG. 9*b*, 9*c* are W1-W1 line sectional view, W2-W2 line sectional view respectively.

FIG. 10*a*, 10*b*, 10*c* are front view of other embodiment of the joint member used for the discharge container of present invention, respectively.

FIG. 11*a* is a plan view showing the other embodiment of the discharge container of the present invention, FIG. 11*b*, 11*c* are a plan view and a cross sectional view showing the other embodiment of the valve holder which can be used to the discharge container of the present invention.

EMBODIMENT FOR CARRYING OUT THE INVENTION

A discharge container 10 of FIG. 1 is equipped with a container body 11 made of metal, a valve assembly 12 fixed to the container body, and two inner container 13 inserted in the container body 11. Different contents are stored into the container of the discharge container respectively, and the propellant is charged into the space between the container body 11 and the inner container 13, to become the discharge product. That is to say, the discharge container 10 is a container can simultaneously discharge two contents.

The container body 11 made of metal has a barrel portion 11*a* having tube shape in which the lower end is closed by the bottom portion, a shoulder portion 11*b* having tapered shape which extends upwardly reducing the diameter from the top of the barrel portion, a neck portion having tube shape which is provided on top of the shoulder portion, and a bead portion 11*d* formed annularly top of the neck portion. The neck portion 11*c* and the bead portion 11*d* configures the opening of the container body 11, and the inner diameter of the neck portion and the inner diameter of the bead portion are made to be same.

The container body 11 is formed with steps of forming a tubular body having a bottom from a disc made of metal such as aluminum and etc. by impact processing or deep drawing processing, or from a metal cup by deep drawing processing; providing a synthetic resin coating in the inner surface thereof; forming the shoulder portion and the neck portion on top of the barrel portion by necking processing; and forming the bead portion 11*d* on top of the neck portion by curling processing.

The valve assembly 12 is equipped with a valve holder 16 inserted into the opening of the container body 11 two independent aerosol valve 17 fixed to the valve holder, an O-ring 18 provided on the outer surface of the valve holder 16, and a cover cap 19 covering them and fixed to the outer surface of the opening of the container body.

The valve holder 16 has, like shown in FIG. 2*a*, 2*b*, a plug portion 21 inserted into the opening of the container body 11, a flange portion 22 which is projected radially outwardly from the upper end of the plug portion 21 and which is provided above on the bead portion 11*d* of the container body 11, and a lid portion 23 projected upwardly from the upper surface of the flange portion 22. In the valve holder 16, there are two penetrating holes 24 which vertically penetrates the plug portion 21 the flange portion 22, and the lid portion 23. The aerosol valve 17 is inserted into the penetrating hole 24 and is fixed to the valve holder with the cover cap 19.

On the outer surface of the plug portion 21, an annular recessed portion 21*a* for holding the O-ring 18 is formed. The bottom of the recessed portion 21*a* (lateral surface of plug portion) is formed to be vertical plane. The position of the recessed portion 21*a* is designed so as the O-ring 18 held by the recessed portion 21*a* is in contact with the neck portion (cylindrical portion) of the opening of the container body 11, when the lower part of the cover cap is clinched to the container body 11 from the outside. In this embodiment, it is provided on the lower part of the plug portion 21.

The lid portion 23, like shown in FIG. 1*b* and FIG. 2*b* has a cross sectional arc shape where a notch portion 23*a* of a fan shape is trimmed from the circle, to verify the direction of entire container.

Two penetrating holes 24 are formed in a line parallel with the notch portion 23*a* of the lid portion 23 and opposing to each other. The penetrating hole 24 has a support step portion 26 having a tapered shape which extends downwardly reducing the diameter. The shape of the support step portion 26 is not limited as long as it can hold the aerosol valve 17 discussed below.

On top of the support step portion 26, an inside inner surface 17 which continues from the support step portion 26 is formed. On the outside of inside inner surface 27, an outside inner surface 29 is formed across the annual channel portion 28. The inside inner surface 27 has a contacting surface 27*a* having tubular shape, a reduced diameter step portion 27*b* formed on top of the contacting surface, and a sealing portion 27*c* having tubular shape contacts with the O-ring 35 sealing a gap between the aerosol valve 17 and the penetrating hole 24. However, the reduced diameter step portion 27*b* may be omitted and have the abutting surface 27*a* and the sealing portion 27*c* to be combined.

On the bottom of the support step portion 26, a lower inner surface 30 having tubular shape extending downwardly is provided, and on its lower side, an engaging claw 30*a* projecting in inner side of the radial direction is provided. The engaging claw 30*a* is formed to hold the joint member 42 which connects the valve holder 16 and the inner container 13. For the alternative of the engaging claw 30*a*, it may be designed to have the lower inner surface 30 and the tubular joint member 42 to fit with each other.

The aerosol valve 17, shown in FIG. 2*c*, is an assembly which united a housing 31 having a tubular shape, a valve structure 32 housed in the housing 31, and a cap 33 covering the housing 31 and fixing the valve structure 32 to the housing 31. The housing 31 of the aerosol valve 17 works as a pathway of the content, and the valve structure 32 opens and closes the housing. The housing 31 of the aerosol valve 17 is inserted in the penetrating hole 24 of the valve holder 16, and the aerosol valve 17 is fixed to the valve holder 16.

The housing 31 is a tubular object having a bottom, where a tubular joint portion 31*a* is formed on the lower end extending downwardly, where a holding step 31*b* holding the valve structure 32 is formed on the top of the inner surface, and where a projecting portion 31*c* is formed on the top of the outer surface projecting in radially outwardly direction. Further, on the outer surface of the housing, a recessed portion 31*d* for holding the O-ring 35 is formed. The bottom of the recessed portion 31*d* (lateral surface of plug portion) is formed to be vertical plane. Moreover, an annular step portion 31*e* where the diameter decreases downwardly, is formed on the lower side of the recessed portion 31*d*. Therefore, when the aerosol valve 17 is inserted into the penetrating hole 24, the annular step portion 31*e* engages with the support step portion 26 of the penetrating hole 24, and the O-ring 35 held by the recessed portion 31*d* contacts with the sealing portion 27*c*. For the housing 31, a compact formed by injection molding from the synthetic resin such as poly-acetal may be used.

O-ring 35 is pressed in radial direction between the recessed portion 31*d* of the housing 31 and the sealing portion 27*c* of the valve holder 16 and seals the gap between the two by restoring force.

The valve structure 32 is equipped with a stem rubber 36 having a flat ring shape held by the holding step 31*b* of the housing 31, a stem 37 having a cylindrical shape which is to be inserted in the stem rubber, and a spring which always forces the stem 37 upward. The stem rubber 36 having a ring shaped in which the stem 37 is inserted in the bore portion, closes the housing 31 by provided on the holding step portion 31*b* of the housing 31. A stem communicating hole 37*b* is formed on the lateral face of the stem 37, which communicates with a stem inside path 37*a* formed in the center of the stem 37. When the stem 37 is inserted in the stem rubber 36, the bore portion of the stem rubber 36 closes the stem communicating hole 37*b*. Therefore, the housing 31 is always covered by the stem rubber 36. And by lowering the stem 37 against the stem rubber 36, the gap is formed between the stem 37 and the stem rubber 36 and the stem communicating hole 37*b* is opened. As a result, the inside of the housing 31 and the stem inside path 37*a* is communicated. However, the valve structure 32 is not limited to above, as long as it closes the housing 31 of content path, and opens the housing 3 of content path by some kind of operation. The spring 38 is provided between the bottom portion of the housing and the lower end of the stem 37.

The cap 33 of FIG. 1 fixes the stem rubber 36, the stem 37, and the spring 38 in the housing 31. The cap 33 covers the top of the housing 31 and the lateral face 33*b* is clinched to the projecting portion 31*c* of the housing 31. Therefore, the stem 37 is forced upward by the spring 38 where the stem communicating hole 37*b* is sealed by the stem rubber 36, and it is easy to handle the aerosol valve 17 as a whole when assembling. The lower end 33*a* of the cap 33 is extended straight in lowering direction. When the aerosol valve 17 is inserted in the penetrating hole 24, the lower end 33*a* of the cap 33 is inserted in the annual channel portion 28. The cap is formed with metal such as aluminum.

The O-ring 18 of the valve holder 16 is a sealing member having a cross sectional view of circle before the valve assembly 12 is fixed to the container body 11 and before it is plastically deformed. The O-ring 18 is pressed in radial direction between the recessed portion 21*a* of the valve holder 16 and the neck portion 11*c* of the container body, and seals its space by the restoring force. Especially the clinching claws which force the neck. portion 11*c* of the container body 11 inside from the outside controls the press force of the sealing part, of the O-ring 18. The O-ring 18 is made of elastic material such as nitrile rubber (NBR), butyl rubber (IIR), fluoro rubber, silicone rubber and etc. The O-ring 35 of the valve structure 32 also is essentially made of same material as the O-ring 18 of the valve holder 21.

Back to FIG. 1, the cover cap 19 is composed of an upper base 19*a* which covers the top of the container body, valve holder 16 and the aerosol valve 17, an upper tube portion 19*b* which covers the periphery of the valve holder 16 and the lid portion 23, and a lower tube portion 19*c* which covers the flange portion 22 of the valve holder 16 and which fixes the valve holder 16 and the aerosol valve 17 to the container body 11. On the upper base portion 19*a*, a hole 20*a* which passes the stem 37 of the aerosol valve 16, and a recessed portion 20*b* which presses the cap of the aerosol valve are formed. The cross sectional shape of the upper tube portion 19*b* is a circle in which a part is been deleted like the lid portion 23 of the valve holder 16 (see FIG. 1*b*). The lower tube portion 19*c* is a fixing portion which sandwiches the flange portion 22 of the valve holder 16 and the bead portion 11*d* of the container body 11. This lower tube portion 19*c* has a cylindrical shape before assembled, and is formed by plastic deforming the lower end 19*d* of the lower tube portion 19*c* which is to clinch the lower end 19*d* inside to the bead portion 11*d* of the container body 11 with clinching claw (plastic deforming portion).

The cover cap 19 is made of metal such as aluminum, tin plate and etc.

The inner container 13 is equipped with a pouch 41 and a joint member 42 having a cylindrical shape which is welded or adhered to the opening of the pouch 41.

The pouch 41 is formed by welding or adhering plural of sheets. As for the sheet, a synthetic resin sheet such as polyethylene, polyethylene-terephthalate, nylon, eval, a vapor deposited resin sheet in which a silica or alumina is vapor deposited to the above synthetic resin, and a laminated sheets in which a metal foil such as an aluminum foil is laminated to the synthetic resin sheet, can be used.

The joint member 42 is composed of a pouch fixing portion 42*a* adhered to the opening of the pouch 41, and a valve joint portion 42*b* which couples with the joint portion 31*a* of the aerosol valve 17. The valve joint portion 42*b* is engaged to the engaging projection 30*a* of the valve holder, however it may be engaged to the joint portion 31*a* of the aerosol valve 17, On the lower end of the pouch fixing portion 42*a* of the joint member 42, a tube 42*c* which is inserted in the pouch 41, is provided. However, the tube 42*c* may not be provided. For the joint member 42, an injection molding piece may be used.

In this embodiment, the pouch 41 is used. However, a collapsible inner bag made of synthetic resin such as polyethylene, eval, or etc. for double aerosol container may be used. In that case, joint member may also be used to couple the inner bag and the container body, but the inner bag may be directly fitted to the joint portion of the housing of the aerosol valve.

The discharge container 10 is manufactured by next steps. The valve assembly 12 in which the inner container 13 is fitted is held above the bead portion 11*d* of the container body 11 (see FIG. 3*a*). Then, the propellant is charged in the arrow direction, through the space between the lower end 19*d* of the cover cap 19 and the bead portion 11*d* of the container body 11, and the space between the valve holder 16 and the bead portion 11*d* (under cup charging). Simultaneously, the valve assembly 12 is lowered and have the O-ring 18 in contact with the neck portion 11*c* (cylindrical portion) of the container body 11. And the lower end 19*d* of the lower tube portion 19*c* of the cover cap 19 is plastically deformed against the neck portion 11*c* of the container body 11 to be fixed with the bead portion 11*d* by the clinching claw 20. At this moment, the neck portion 11*c* lower than the bead portion 11*d* is pressed inside by the tip of the clinching claw 20 and the pressing force of the O-ring 18 is controlled. In other word, the tip of the clinching claw 20 and the O-ring 18 is provided at same height while clinching. For the content, it may be charged into the inner container 13 before assembling the valve assembly, and it may be charged into the inner container 13 after the charging of the propellant and assembling of the valve assembly 12 to the container body by opening the stem 37.

In the above manufactured discharge container 10, the deformation amount of the O-ring 18 may be controlled in 0.1 millimeter order by deforming the cylindrical portion (neck portion 11*c*) in micro order, when fixing the cover cap 19. Therefore, the durability and accuracy of the sealing function is high. Further, although the dimension of the formed item of the container body 11 and the valve holder 16 of the valve assembly has margin of error, or that the inner surface of the container body 11 has wrinkles formed on the necking processing, the sealing function can be controlled at the last stage, therefore the manufacturing method of the discharge container 10 can be operated easy and will have high productivity. Further, because the fixing portion (lower tube portion 19*c*) of the cover cap 19 and the sealing structure (O-ring 18) are independent with each other, the cover cap 19 can be fixed firmly. Moreover, because the lower end 19*d* of the lower tube portion 19*c* of the cover cap 19 is deformed toward the neck portion 11*c*, the plastic deformation can be secured.

On the discharge container 45 of FIG. 4, an annular hollow portion 46 pitted inside is formed on the neck portion 11*c* of the container body 11, for pressing the O-ring 18 held in the recessed portion 21*a* of the plug portion 21 of the valve holder 16. The outer diameter of the lower late a surface 47*a* of the plug portion 21 of the valve holder 16 (part lower than the recessed portion 21*a*) is some what smaller than the lateral surface of the plug portion 21 to support the annual hollow portion 46. That is, because the outer diameter of the lateral surface of the plug portion 21 of the valve holder 16 (part higher than the recessed portion 21*a*) is some what larger than the lower lateral surface 47*a* (part lower than the recessed portion 21*a*), it can avoid the O-ring 18 to escape upward and to twist when the valve holder 16 is inserted into the container body 11. The rest of the composition is substantially same as the discharge container of FIG. 10.

By providing the annular hollow portion 46, the sealing function can be enhanced by having the O-ring 18 to be pressed not just from left and right but also from up and down. The annular hollow portion 46 can be formed after the assembling of the discharge container 10 worked from outside or at the manufacturing of the container body 11.

Further, the outer diameter of the lower lateral surface 47*a* of the plug portion 21 may be designed to be same or slightly larger than the inner diameter of the annular hollow portion 46 of the container body 11, and the lateral surface and the lower lateral surface 47*a* of the plug portion 21 may be provided with a channel extending vertically to create the passage for the propellant to be charged.

The discharge container 50 of FIG. 5*a* is equipped with a container body 51 made of metal, a valve assembly 52 fixed to the container body, and an inner container 13 inserted into the container body 51. The container body 51 is substantially same as the container body 11 of FIG. 1, except that a barrel portion 51*a*, a shoulder portion 51*b*, a neck portion 51*c*, and a bead portion 51*d* have small diameter than the container body 11. The inner container 13 is substantially same as the inner container 13 of FIG. 1. The discharge product is produced by storing the content in the inner container 13 of the discharge container 50, and by charging the propellant in the space between the container body 51 and the inner container 13. The discharge container 50 is a container which discharges one content.

As for the valve assembly 52, the valve structure 32 is directly fixed to the penetrating hole. That is, the penetrating hole of the valve holder works as the passage of the content.

The valve assembly 52 is equipped with a valve holder 56 inserting into the opening of the container body 51, a valve structure 32 fixed to the valve holder, an O-ring 18 provided on the outer surface of the valve holder 56, and a cover cap 59 covering those and fixed to the outside of the bead portion of the container body. The O-ring 18 and the valve structure 32 are substantially same as those of FIG. 1.

The valve holder 56 has a plug portion 21 having column shape, a flange portion 22, and a lid portion 23 having column shape and is substantially same as the valve holder 16 of FIG. 1, except for that the valve holder 56 has one penetrating hole 56*a* and has a columned shape without the notch portion.

The penetrating hole 56*a* is formed with a spring support portion 57*a* supporting the spring 38 of the valve structure 32, and a holding step 57*b* formed on top of the inner surface holding the stem rubber 36 of the valve structure.

The cover cap 59 has a upper base 59*a* which is formed in accordance with the shape of the valve holder 56 and which has a hole 60*a* on the center for the stem to be inserted, an upper tube portion 59*b* having a cylindrical shape, and a lower tube portion 59*c* formed on below the upper tube portion.

This discharge container 50 is also manufactured like the discharge container 10 of FIG. 1. That is, after the charging of the propellant, the valve assembly 52 is lowered to have the O-ring 18 to be in contact with the neck portion 51*c* (cylindrical portion) of the container body 51, and the cover cap 59 is fixed to the container body 51 by plastically deforming the lower end 59*d* of the lower tube portion 59*c* of the cover cap 59 toward the neck portion 51*c* of the container body 51 with the clinching claw. Therefore, the pressing rate of the O-ring 18 can be controlled by pressing the neck portion 51*c* of the container body 51 inwardly with the tip of the clinching claw. Resultantly, the durability and the accuracy of the sealing function are high.

The discharge container 60 of FIG. 5*b* is equipped with a container body 51 made of metal, and the valve assembly 52 fixed to the container body. The discharge container 60 does not have the inner container and it is provided with the dipping tube 61 fixed to the lower end of the valve holder 56 of the valve assembly 52, except that the rest of the composition is substantially same as the discharge container 50 of FIG. 5*a*.

The discharge product is produced by charging both the content and the propellant into the container body 51 of the discharge container 60.

The discharge container 70 of FIG. 6*b* is equipped with the container body 51 made of metal, a valve assembly 72 fixed to the container body, and the inner container 73 inserted into the container body 51. The container body 51 is substantially same as the container body 51 of FIG. 5.

In this discharge container 70, the inner bag having collapsible behavior made of synthetic resin is used as the inner container 73 and the shape of the valve holder of the valve assembly 72 is different from the valve holder of discharge container 50 of FIG. 5*a*, other than that, the discharge container 70 is substantially same as the discharge container 50 of FIG. 5*a*.

The valve assembly 72 is equipped with a valve holder 75 inserted into the opening of the container body 51, a valve structure 32 fixed to the valve holder, an O-ring 18 provided on the periphery of the valve holder 75, and a cover cap covering them and fixed to the periphery of the opening of the container body. The O-ring 18 and the valve structure 32 are substantially same as the one of FIG. 5.

In the valve holder 75, the flange portion doubles as the lid portion. For the other compositions, it is substantially same as the valve holder 56 of FIG. 5, where it has cylindrical column shape without the notch portion, and has plug portion 21 and flange portion 22.

The cover cap 74 has a tube portion 74*a* which is formed in accordance with the shape of the valve holder in which the upper tube portion and the lower tube portion is united. The other configuration is substantially same as the valve holder 56 of FIG. 5

This discharge container 70 is also manufactured like the discharge container 50 of FIG. 5. That is, the valve assembly 72 fitted with the inner container 73 is held above of the bead portion 51*d* of the container body 51 (see FIG. 6*a*). Then, the propellant is charged in arrow direction from a space between the lower end 74*d* of the cover cap 74 and the container body 51 to a space between the container body 51 and the valve holder 75. Simultaneously, the valve assembly 72 is lowered to have the O-ring 18 to be in contact with the neck portion (cylindrical portion) of the container body. Finally, the lower end 74*d* of the cover cap 74 is plastically deformed toward the neck portion 11*c* of the container body 11 with the clinching claw and have the cover cap 74 fixed to the bead portion 51*d*. During this clinching process, the press force of the O-ring 18 is controlled by pressing the neck portion 51*c* of the container body 51 inside with the tip of the clinching claw 20. Therefore, the durability and the accuracy of the sealing function are high.

The discharge container 80 of FIG. 7 comprises a joint member 82 which efficiently guides the content in the pouch 41 to the valve assembly 12. That is, the joint member 82 of the inner container 81 has a guiding portion 83 which is to be inserted in the pouch 41. The container body 11 made of metal, the valve assembly 12, and the pouch 41 are substantially same as those of discharge container 10 of FIG. 1.

The joint member 82, like shown in FIG. 8, has a pouch fixing portion 42*a*, a valve connecting portion 42*b*, and the guiding portion 83 which extends downward from the lower end of the pouch fixing portion 42*a*. The pouch fixing portion 42*a* and the valve connecting portion 42*b* are substantially same as those of discharge container 10 of FIG. 1.

The guiding portion 83 comprises a main body 84 extending vertically, a communicating portion 85 which is provided on top of the main body 84 and which communicates the surface of the main body 84 with the center hole of the valve connecting portion 42*b*, a projecting portion 86 which extends vertically and which is projected from the surface of the main body, and a bottom portion 87 having a circular plate shape formed on the lower end of the main body 84.

The main body 84 is flat plate extending vertically. However, it may be a pole (cylindrical column) like shown in FIG. 8*e*.

The communicating portion 85 is a hole formed vertically from the top of the main body 84 and which communicates with the center hole of the valve fixing portion 42*a*.

The projecting portion 86 is composed of plural of main projections 91 formed concentrically and formed apart in vertical direction, and plural of sub projections 92 which is provided between the adjacent main projections 91 and which does not intersect with the main projections 91. The main projection 91 is projected perpendicularity against the surface of the pouch 41, and the sub projection 92 is projected parallel with the surface of the pouch 41.

The main projection 91, like shown in FIG. 8*a*, 8*h*, 8*c*, is composed of plural of first main projections 91*a* formed concentrically and formed on the front surface of the main body 84 (left side of the FIG. 8*b*), and the plural of second main projections 91*b* formed concentrically and formed on the rear surface of the main body 84 (right side of FIG. 8*b*). In this embodiment, the first main projections 91*a* and the second main projections 91*b* are projected in opposite directions on the same position so as to be like a pair. First main projections 91*a* and second main projections 91*b* each have four projections. However, the numbers are not limited as long as it is more than two. It is preferable to have 2 to 8.

An axis line cross sectional view of the main projection 91 is half moon shape. The center of the main projection has the largest protruding amount from the main body 84 and the protruding amount gently decreases toward the upper end and the lower end. Further, a horizontal. line cross sectional view of the main projection 91, like shown in FIG. 8*c*, is a mountain shape, where the top is curved or flat and the slope is slightly curved so as to project outwardly or flat.

The space between the adjacent first main projections 91*a* or the space between the adjacent second main projection 91*b* is a plane face portion 93 which is a front surface or a rear surface of the main body 84.

Further, on the foot of the main projection 91 (first main projection 91*a* and second main projection), there is channel portion 94 formed parallel with the main projections 91 respectively (see FIG. 8*a*, 8*c*). On the other hand, if the main body 84 has a cylindrical column shape like shown in FIG. 8*e*, the plane face portion 93 will be curved surface, and the straight passage will be formed between the foot of the plane face portion which is curved and the channel portion 94.

The sub projection 92 has plural of first sub projections 92*a* provided on one line on the right lateral face of the main body 84 (right side of FIG. 8*a*) and plural of second sub projections 92*b* provided on one line on the left lateral face of the main body 84 (left side of FIG. 8*b*). In this embodiment, each of the first sub projection 92*a* and the second sub projection 92*b* is provided not just between the adjacent main projections, but also between the main projection 92*a* and the pouch fixing portion 42*a* and between the main projection 91 and the bottom portion 87. The height of the first sub projection 92*a* and the second sub projection 92*b* are arranged in same pattern forming a pair. The position of top and bottom of the sub projection 92 and position of the bottom and top of the main projection 91 overlaps in side view.

An axis line cross sectional view of the sub projection 92 is half moon shape (see, FIG. 8*a*). That is the projecting amount is maximum at the center of the sub projection 92 and the projecting amount decreases toward the top and bottom.

Moreover, on the first sub projection 92*a* and the second sub projection 92*b*, a protrusion 96 is formed perpendicular to the surface of the pouch (same direction as the main projection 91) (see FIG. 8*b*, 8*c*). The protrusion 96 is provided on the front and rear surface of the first sub projection 92*a* and the second sub projection 92*b*. The protrusion 96 has a half moon shape in axis line sectional view, in which the protruding amount increases toward the middle from the outside forming a inclined line or a curved line. On the other hand, the shape of the lateral face including the first sub projection 92*a* and two protrusions 96 formed on its side can be designed to be half rugby ball shape and the shape of the other lateral face including the second sub projection 92*b* and the two protrusions 96 formed on its side can be designed to be half rugby ball shape, and can be designed to be approximately rugby ball shape as a whole.

The largest protruding part of the main projection 91 and the sub projection 92 are provided to be apart vertically. The plane face portion 93 is provided between the first sub projection 92*a* and the second sub projection 92*b*. The channel portion 94 of the main projection 91 has an opening between the vertically adjacent sub projections 92. And the vertically adjacent sub projections 92 and the plane face portion 93 are communicated with channel portion 94. Although the largest protruding part of the main projection 91 and the sub projection 92 are provided vertically apart, the upper end and the lower end of the main projection 91 and the sub projection 92 is overlapped in vertical direction. Therefore, the passages formed of main projection and the sub projection can be connected easily.

The bottom portion 87 having a circular disk shape is formed to be perpendicular to the surface of the pouch 41. To have the bottom portion in circular disk shape, the pouch 41 won't be ruptured when the pouch 41 shrink and contact with the bottom portion 87. It is designed to have the bottom portion 87 not to come in contact with the bottom portion of the pouch 41. In other word, there is a space between bottom portion 87 and the bottom portion of the pouch 41, therefore, when pouch 41 shrinks and if the pouch 41 shrinks in vertical direction, the bottom portion 87 will not press the pouch 41 and tear the pouch 41. Further, because the pouch 87 has three-dimensional conformation, the passage between the bottom portion 87 and the pouch is formed. Further, it is preferable that the both side ends of the bottom portion 87 perpendicular to the surface of the pouch protrudes outside compare to the tip of the first main projection 91*a* and the second main projection.

Next, the process of content discharging from this discharge product is described, especially the passage formed by the joint member is described.

Back to FIG. 7, the valve structure of the valve assembly 12 is opened. by lowering the stem 37 of the discharge container 80, and the atmosphere communicates with the inside of the pouch 41. Therefore, the pouch 41 is been pressed by the propellant charged in the space between the container body 11 and the pouch 41, and the content which is guided to the center hole of the valve fixing portion 42*b* by the guiding portion 83, is pushed out from the pouch 41 and discharged outside through the stem 37.

The pouch 41 will contract and the surface of the pouch will be in contact with each other, however the passage will be maintained by the action of the guiding portion 83.

That is, along with the discharge of the content, an upper part of the surface of the pouch 41 in vicinity of the communicating portion 85 will be pressed inside and come close with the opposite surface of the pouch 41, and this part will come in contact with the protrusion portion 86. And by further discharging the content, the pouch 41 deforms in perpendicular direction pressing the main projection 91 and the protrusion 96 (see FIG. 9*b*), and at the same time, the surface of the outside edge of the pouch 41 (edge which is apart from the guiding portion contact with each other, and deform horizontally toward the center axis of the pouch 41 in the contact state (see FIG. 9*a*, 9*c*). The hatch line of the net in FIG. 9*a* shows the part where the opposing surfaces are in contact with each other.

In the deformation of the pouch 41 in perpendicular direction, the main projection 91 and the protrusion 96 projecting in the perpendicular direction against the surface of the pouch behaves as the rib against the contracting surface of the pouch 41, like shown in FIG. 9*b*. And forms a space between the guiding portion 83 and the pouch 41 (space formed on the front and back of FIG. 9*b*). That is to say, the space is formed between the plane face portion 93 which is surrounded by the above and below main projections 91 and right and left protrusions 96, and the pouch 41, and formed between the hemline of the main projections 91 (channel portion 94) and the pouch 41. And this space forms the passage P1 of vertical direction on the main body 84 which connects the inside of the pouch 41 with the communication portion 85. Moreover, because the adjacent, up and down passages P1 are formed on same line, the contents are carried in straight line on the plane face portion 93, therefore it is efficient. Further, even if the pouch 41 is shrunk or the pouch 41 is elongated and the space disappeared by the surface of the pouch 41 cohere with the main projection 91, the passage P1 can be secured by the channel portion 94.

On the other hand, as shown in FIGS. 9*a*, 9*c*, in the deformation of the pouch 41 in the horizontal direction, the cohesion of the front and back surface of the pouch 41 between the adjacent sub projections 92 is prevented by the sub projections 92 projecting in parallel with the pouch surface and protrusions 96 projecting perpendicularly against the surface of the pouch 41. Further, it prevents the part of the pouch 41 in which the front and back is cohered, to deforms toward the axis, and prevents the space formed between the sub projection 92 to be shut. Therefore, the space between the adjacent sub projections 92 is secured. This space secured between the adjacent sub projections 92 forms the sub passage P2 which communicates the inside of the pouch with the passage P1. In this embodiment, the sub passages P2 are formed on left, right, top, and bottom, therefore, the contents are applied from the upper side of the pouch 41 (upper side of the sub passage P2). And, even if the pouch 41 is cohered with the lower part of the guiding portion 83 while deforming, the passage won't be blocked, and the contents can be discharged till the end.

Further, because the axis line cross sectional view of the main projection 91 is half moon shape, it ease the formation of the space between the plane face portion 93 and the pouch 41. Moreover, because the cross sectional shape on the horizontal direction of the main projection 91 is mountain shape where the tip is curved, the pouch 41 will not be torn even if the pouch 41 comes in contact with the main projection 91 by the press force of the propellant.

Because, the protrusion 96 also has axis line cross sectional view is half moon shape, in which the projection amount increases from the outer edge to the inside, the pouch 41 will not be torn even if the pouch 41 comes in contact with the protrusion 96 by the press force of the propellant.

One embodiment of the guiding portion 83 is shown in the joint member 82 of FIG. 7. However, the guiding portion is preferable as long as it is three dimensional structure having two main projections formed apart in vertical direction and formed on one straight line.

This joint member 82 may be used to other discharge containers which are not present invention, as long as the discharge containers are a double aerosol container which is equipped with a pouch. For example, an aerosol container having a pressure resistant container made of synthetic resin, a pouch housed in the container, and a valve assembly having valve structure which communicates the outside with the inside of the pouch, where the propellant is charged between the container and the pouch. This joint member 82 can efficiently guide the content in the pouch to outside.

Due to forming the sub projection between two main projections and without crossing with the main projection like the joint member 82 of FIG. 7, a bumpy surface having three dimensional structures can be formed on the surface of the guiding part. And because the surface area of the passage member (guiding portion) is greatly increased, the formation of the space between the passage member and the pouch will be facilitated. Especially, by having the sub projection between the adjacent main projections where the pouch most likely contacts, the formation of the space between the flat surface (surface of the main body of the guiding portion) which is formed between the adjacent main projections and the pouch will further be facilitated. However, the sub projection may be omitted.

Like the joint member 82 of FIG. 7, by forming the channel on the hemline of the main projection parallel to the main projection, the passage parallel to the main projection can be secured. However, the channel portion may be omitted.

Like the joint member 82 of FIG. 7, by having the main projection projected perpendicular to the surface of the pouch, and the sub projection projected parallel to the surface of the pouch, the contraction of the pouch can be controlled. However, as long as the main projection and the sub projection which forms the three dimensional structure between the guiding portion and the pouch, the projecting direction of the main projection and the sub projection is not limited.

Like the joint member 82 of FIG. 7 having the protrusion 96 projected perpendicular to the surface of the pouch on the sub projection, the surface area of the passage member will be further increased. Especially the protrusion is formed away in vertical direction from the main projection, it prevents surface of the pouch to contract, secure the passage formed in vertical direction, and secure the sub passage guiding the space between the sub projections to the hemline of the main projection.

The joint members of FIGS. 10*a* to 10*c* are the alternatives of the joint member 82 of FIG. 7.

In the joint member 82*a* of FIG. 10*a*, the flat surface 93 of the joint member 82 of FIG. 7 is replaced by a penetrating hole 98. By having penetrating hole 98, the material can be reduced. The other configuration is substantially same as the joint member 82 of FIG. 7, and has the pouch fixing portion 42*a*, the valve connecting portion 42*b*, and the guiding portion 83.

In the joint member 82*b* of FIG. 10*b*, the sub projection 92*a*, 92*h* is projected to form an isosceles trapezoid from the main body 84, both sub projections are longer than the sub projections of joint member 82 of FIG. 7, and the distance between the adjacent sub projections is smaller than the joint member 82 of FIG. 7. It eases the formation of the sub passage P2. The other configuration is substantially same as the joint member 82 of FIG. 7, and has the pouch fixing portion 42*a*, the valve connecting portion 42*b*, and the guiding portion 83.

In the joint member 82*c* of FIG. 10*c*, the projection amount of the main projection 93*a*, 93*b* is larger than the main projection 91*a*, 91*b* of the joint member 82 of FIG. 7. It creates larger bump on the main body 84, and further secures the formation of the passage P1.

The discharge container 95 of FIG. 11*a* has a penetrating hole 97 on the upper base 96*a* of the cover cap 96 for ejecting the propellant intruded between the cover cap 96 and the valve holder 16. Generally the quality test or inspection of the discharge container in which the propellant is charged, is conducted by having the assembled discharge container to be dipped in the water (hot water) and check the existence of the bubble. However, in this discharge container, there is a chance that the propellant may intrude between the valve holder 16 and the cover cap 96 during the under cup charging of the propellant. This penetrating hole 97 ejects such a propellant before the test. As a result, the quality test can be conducted with accuracy.

Further, in this discharge container 95, a dented portions 20*b* are formed on the upper base 96*a* of the cover cap 96 other than the recessed portion 20*b* pressing the cap of the aerosol valve, for holding or pressing the valve holder 16 and the aerosol valve 17. This dented portion 20*b* further prevents the valve holder 16 to move against the external force and inner pressure.

Other configuration is substantially same as the discharge container 10 of FIG. 1. Further, guiding channel 99 to guide the propellant intruded between cover cap 96 and the valve holder 16 to the penetrating hole 97, may be provided on the upper surface of the valve holder 16, like the discharge container of FIG. 11*b*, and FIG. 11*c*.

The invention claimed is:

1. A discharge container, comprising;

a container body made of metal having an opening, and a valve assembly fixed to the opening of the container body, wherein the container body has a cylindrical barrel portion, a cylindrical neck portion having a diameter smaller than the barrel portion, and a bead portion formed on top of the neck portion, wherein the opening has a cylindrical portion and the bead portion formed above the cylindrical portion, wherein the valve assembly is equipped with a plug portion inserted into the opening, a flange portion which is provided above on the bead portion, a valve structure which opens and closes a pathway of a content and is fixed to the plug portion, an O-ring provided on an outer surface of the plug portion, and a cover cap fixing the valve assembly to the container body, wherein on the outer surface of the plug portion, an annular recessed portion for holding the O-ring is formed, wherein the cover cap has an upper portion covering the plug portion and the valve structure, and a plastically deformable portion fixed to the bead portion by deforming in a central direction, and wherein the O-ring contacts with a part of the cylindrical portion lower than the plastically deformable portion and seals a gap between the container body and the plug portion.

2. A discharge container according to claim 1, wherein the valve assembly is equipped with a valve holder which retains a plurality of valve structures, and wherein the plug portion is formed on an outer surface of the valve holder.

3. A discharge container according to claim 1, wherein the valve structure is housed in a housing configuring the pathway, and the valve structure is united with the housing by a cap covering the housing, and wherein the housing is fixed to the plug portion.

4. A discharge container according to claim 1, wherein the valve structure is housed in a penetrating hole of the plug portion configuring the pathway.

5. A discharge container according to claim 1, comprising:

a pouch housed in the container body, and a joint member connecting the pouch and the valve assembly, wherein the joint member has a tubular valve connecting portion fixed to the valve assembly;

a tubular pouch fixing portion concentrically provided on a lower end of the valve connecting portion, fixed to the an opening of the pouch;

a guiding portion extending to a bottom portion of the pouch from a lower end of the pouch fixing portion, guiding the content into the pouch fixing portion from the pouch, wherein the guiding portion has a main body extending in vertical direction;

a communicating portion provided on an upper end of the main body, communicating a surface of the main body with a center hole of the pouch fixing portion; and a projecting portion projecting from the main body;

wherein the projecting portion is equipped with at least two main projections formed on a concentrical line and formed apart in vertical direction, and a sub projection provided between the main projections parted in vertical direction and provided as not to intersect with either main projections.

6. A discharge container according to claim 5, wherein a channel is formed on a foot of the main projection in parallel with the main projection.

7. A discharge container according to claim 5, wherein the main projection is projected perpendicular to the surface of the pouch, and the sub projection is projected parallel to the surface of the pouch.

8. A discharge container according to claim 5, wherein the sub projection is equipped with a projection projecting perpendicular to the surface of the pouch.

9. A discharge container according to claim 5, further comprising a bottom portion having a circular plate shape is formed on the lower end of the main body.

10. A discharge container according to claim 1, wherein the valve assembly is equipped with a valve holder having the plug portion retaining the valve structure which is received into the opening of the container body, and a flange portion arranged on an upper end of the opening of the container body, wherein the cover cap covers the valve holder and fixes the valve holder to the container body, and wherein a portion covering the valve holder of the cover cap is formed with a penetrating hole.

11. A method for manufacturing of discharge container from claim 1, comprising:

bringing the O-ring into contact with the cylindrical portion by inserting the plug portion of the valve assembly into the container body, fixing the valve assembly to the container body by plastically deforming a lower portion of the cover cap of the valve assembly with clinch claws depressing in center direction, and at the same time, controlling an outer diameter of the cylindrical portion of the container body with tips of the clinch claw.

* * * * *